United States Patent [19]

Takeshita et al.

[11] 4,374,468

[45] Feb. 22, 1983

[54] ABSORPTION TYPE REFRIGERATION SYSTEM INCLUDING COMPRESSOR DRIVEN AUXILIARY FLOW CIRCUITS ISOLATED FROM MAIN CIRCUIT

[75] Inventors: Isao Takeshita, Neyagawa; Shiro Hozumi, Sakai, both of Japan

[73] Assignee: Matsushita Electric Industrial Company, Kadoma, Japan

[21] Appl. No.: 242,193

[22] Filed: Mar. 10, 1981

[30] Foreign Application Priority Data

Mar. 18, 1980 [JP] Japan ..... 55-35017
Nov. 19, 1980 [JP] Japan ..... 55-163629

[51] Int. Cl.[3] ..... F25D 17/00

[52] U.S. Cl. ..... 62/333; 62/335; 62/476

[58] Field of Search ..... 62/141, 476 X, 335 X, 332, 62/333 X, 175

[56] References Cited

U.S. PATENT DOCUMENTS

| | | | |
|---|---|---|---|
| 2,680,956 | 6/1954 | Haas | 62/175 |
| 3,392,541 | 7/1968 | Nussbaum | 62/175 X |
| 4,025,326 | 5/1977 | Leonard, Jr. | 62/333 X |
| 4,100,755 | 7/1978 | Leonard | 62/476 X |
| 4,176,525 | 12/1979 | Tucker et al. | 62/333 X |
| 4,194,368 | 3/1980 | Bahel et al. | 62/335 X |

*Primary Examiner*—Lloyd L. King

*Attorney, Agent, or Firm*—Pollock, Vande Sande & Priddy

[57] ABSTRACT

An absorption type refrigeration system includes a main flow circuit, a first and a second auxiliary flow circuit. The main flow circuit includes a refrigerant generator containing a solution of evaporable refrigerant in a less evaporable solvent which is heated by solar energy. Pressurized vapor phase refrigerant is supplied to a main condenser and thence to a main evaporator and back to an absorber in which a low refrigerant content solution from the generator is converted to a high refrigerant content solution which is pumped to the generator for recirculation. An electrically driven compressor supplies vapor phase refrigerant through the first auxiliary flow circuit including a condenser, a diaphragm-operated expansion valve, and a first auxiliary evaporator which is arranged to cool the main condenser. The expansion valve is responsive to the vapor pressure of the generator to regulate the pressure of the auxiliary evaporator in a predetermined relationship with the pressure of the main condenser so that the pressure at which refrigerant is evaporated in the first auxiliary evaporator is lower than the pressure at which refrigerant is condensed in the main condenser. The expansion valve is closed when the generator pressure is below the evaporation pressure of the main circuit to direct refrigerant from the compressor to a second auxiliary evaporator.

8 Claims, 3 Drawing Figures

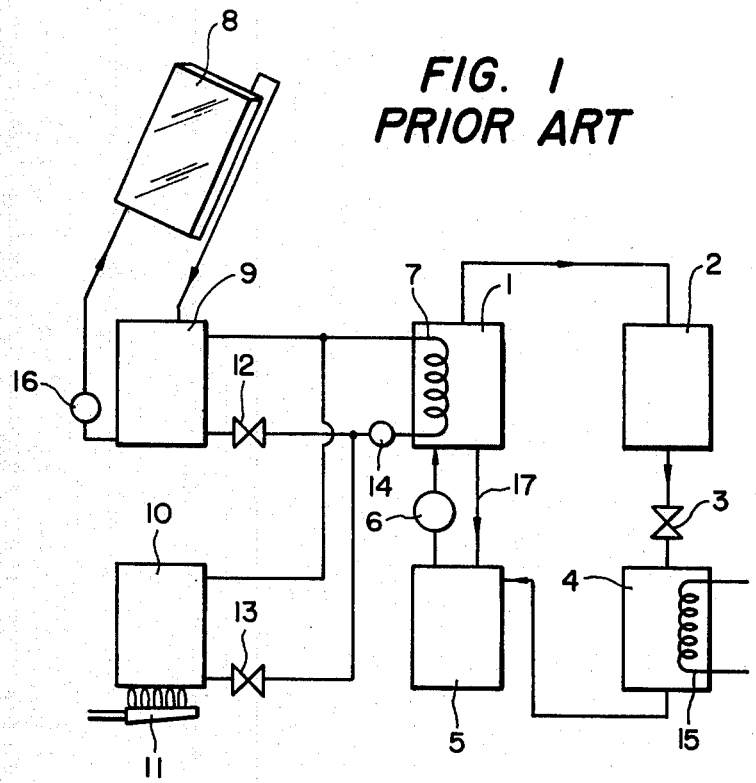
FIG. 1
PRIOR ART
FIG. 2 PRIOR ART
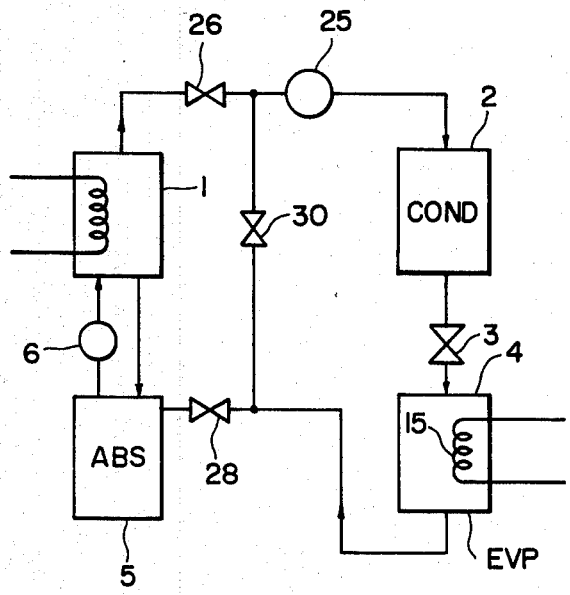

ABSORPTION TYPE REFRIGERATION SYSTEM INCLUDING COMPRESSOR DRIVEN AUXILIARY FLOW CIRCUITS ISOLATED FROM MAIN CIRCUIT

BACKGROUND OF THE INVENTION

The present invention relates generally to refrigeration systems, and in particular to an absorption type refrigeration system for utilizing solar energy or any other form of energy such as wasted heat from industrial plants.

The absorption type refrigeration system comprises a refrigerant generator, a condenser, an evaporator and an absorber all of which are connected in series in a flow circuit. A solution of a high refrigerant content is heated in the generator by hot water supplied from a reservoir which is connected by recirculation flow path to a solar collector. The fact that solar energy erratically fluctuates with weather and climatic conditions has presented difficulty in designing a system which is required to operate consistently regardless of weather. Backup systems are thus usually required to supply energy to the refrigerant generator when solar energy is insufficient to operate the system satisfactorily. The backup system may take the form of a boiler which is brought into operation while shutting off the solar system whenever the pressure of the vapor phase refrigerant in the generator becomes lower than the pressure at which the refrigerant condenses in the condenser. Therefore, a substantial amount of solar-heated water is left unused in the reservoir even though the generator pressure is only slightly below the condensation pressure. In a prior art system a compressor is employed in the vapor phase refrigerant circuit to supply extra power when the generator pressure is lower than the condensation pressure. When the generator pressure falls below the evaporation pressure the refrigerant is circulated through a flow circuit that bypasses the generator and absorber so that the compressor takes full charge of energy supply. However, since the compressor is provided in the flow circuit of the refrigeration system it tends to contaminate the working fluid with lubrication oil or tends to allow the working fluid to introduce to the internal structure of the compressor.

SUMMARY OF THE INVENTION

The present invention contemplates the use of an auxiliary refrigerant flow circuit which is isolated from the main refrigerant flow circuit in which the refrigerant generator and other system's components are provided. In the auxiliary flow circuit a compressor, a condenser and an evaporator are provided. The evaporator of the auxiliary flow circuit is arranged so that it cools the condenser of the main flow circuit. Valve means is further provided in the auxiliary flow circuit to regulate the fluid pressure in the auxiliary evaporator in correlation with the pressure in the main condenser. Preferably, the valve means is responsive to the vapor pressure in the refrigerant generator so that the regulated pressure automatically follows the variation of the pressure in the main condenser. In a further preferred form of the invention, a second auxiliary working-fluid flow circuit is provided in parallel with the first auxiliary flow circuit. The second auxiliary flow circuit includes an evaporator accommodated in a liquid-containing tank with the main evaporator. The valve means is so arranged that when the vapor pressure in the generator falls below a predetermined level corresponding to the evaporation temperature of the main flow circuit evaporator it closes the first auxiliary flow circuit to route the working fluid from the compressor to the second auxiliary evaporator in the second auxiliary flow circuit.

BRIEF DESCRIPTION OF THE DRAWINGS

The invention will be described by way of example with reference to the accompanying drawings, in which:

FIG. 1 is an illustration of a first prior art solar-powered refrigeration system;

FIG. 2 is an illustration of a second prior art solar-powered refrigeration system.

DETAILED DESCRIPTION

Figure 3:
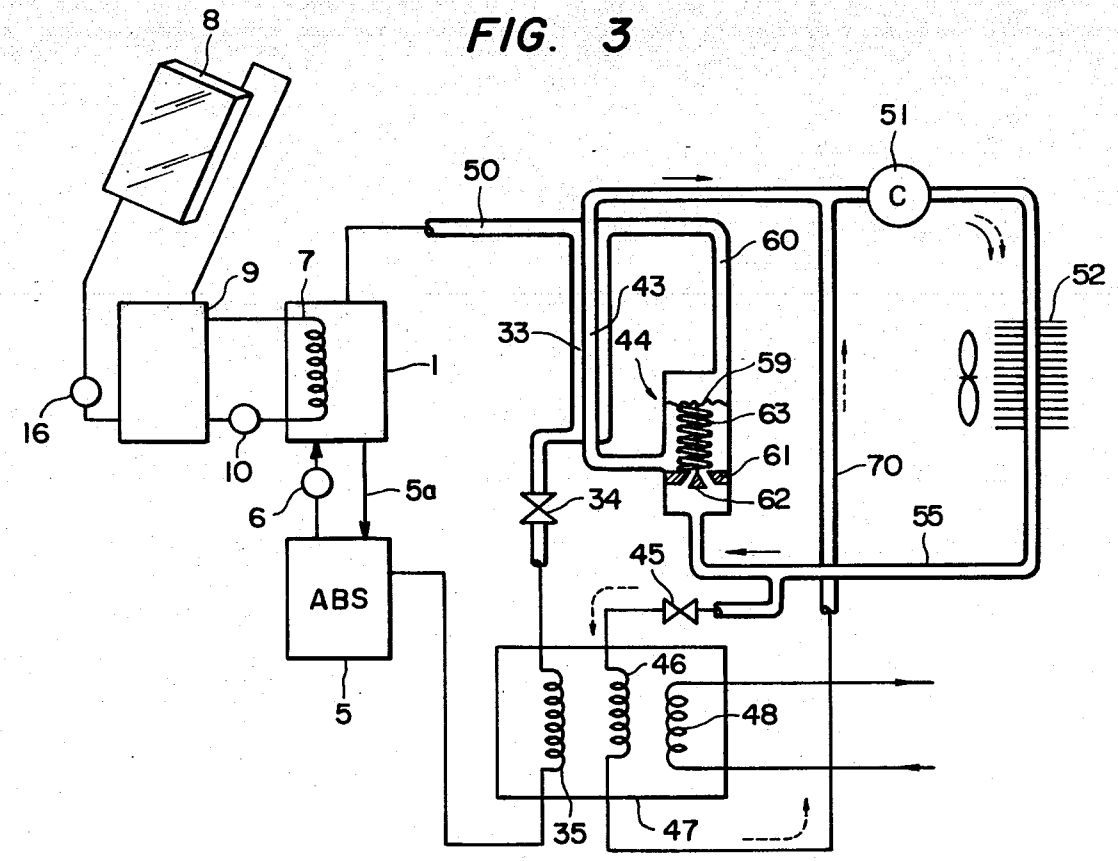
FIG. 3 is an illustration of an embodiment of the solar-powered refrigeration system of the present invention.

Before describing the present invention reference is first made to FIGS. 1 and 2 in which prior art refrigeration systems are illustrated. In FIG. 1, a first prior art system comprises a refrigerant generator 1, a condenser 2, an expansion valve 3, an absorber 5, and a pump 6, all of which are connected in series in a closed-loop working-fluid flow circuit. The generator 1 is provided with a heating coil 7 which is connected in a circuit including a valve 12, and a pump 14 to a hot-water reservoir 9. A solar collector 8 supplies hot water to the reservoir 9 which in turns recirculates the water by a pump 16 to the solar collector 8. The hot water contained in the reservoir 9 is thus pumped through the heating coil 7 to supply energy for generating vapor phase refrigerant by heating a high refrigerant content solution in the generator 1. This high concentration solution is supplied through the pump 6 from the absorber 5 which in turn receives a low refrigerant concentration solution from the generator 1 via a line 17. The vapor phase refrigerant is supplied from the generator 1 to the condenser 2 and thence through the expansion valve 3 to the evaporator 4 to extract heat from the environment by evaporation. The absorber 5 absorbs the vapor phase refrigerant supplied from the evaporator 4 with the low content solution from the generator 1 to supply high refrigerant content solution back to the generator. In the evaporator 4 is provided a cooling coil 15 through which water is passed and cooled water is delivered for utilization. Therefore, in sunny weather the solar collector supplies enough power for vaporizing the refrigerant. To back up the refrigeration system a boiler 10 is provided in which water is heated by a burner 11. The boiler 10 is connected through a flow circuit including a valve 13 in parallel with the reservoir 9 to supply hot water to the refrigerant generator 1. When unfavorable weather conditions continue, the valve 12 is closed and valve 13 is open to supply hot water from the boiler 10 instead of from the solar reservoir 9. One drawback of this prior art system resides in the fact that the backup system frequently comes into play whenever the temperature of the reservoir 9 falls below the minimum operating temperature (typically 75° C.) of the high refrigerant content solution in the generator 1 even though the reservoir 9 contains a large amount of hot water, so that a substantial amount of low temperature energy is not utilized. Since the absorption type refrigeration system is inefficient in comparison with electrically driven compressor type systems in terms of the equivalent amount of primary energy, this prior art system fails to meet the energy savings objective if the backup heat source frequently comes into play. Otherwise, a large number of solar collector panels would be required to supply a high temperature hot water. These disadvantages are solved by a second prior art system of FIG. 2, known as a hybrid system, in which a refrigerant compressor 25 is provided in a flow circuit between the generator 1 and condenser 2 in series with a valve 26. When the solar energy is insufficient to raise the temperature of high refrigerant content solution in the generator to a level required to condense the fluid in the condenser 2, the compressor 25 is brought into operation to provide extra energy. If the solar energy is further reduced so that the pressure of the vapor phase refrigerant in the generator 1 falls below the evaporation pressure of the fluid in the evaporator 4, valves 26 and 28 are closed and a normally closed valve 30 is open to form a closed loop flow circuit containing the compressor 25 as a sole energy source. Therefore, this hybrid system operates in three different modes as a function of the solar energy. Since the amount of work done by the compressor 25 when operating in conjunction with the solar energy source is not substantial compared with the solar energy, this system effectively utilizes the solar energy even if the temperature of the hot water in the reservoir 9 is lower than the temperature required to vaporize the fluid in the generator 1. However, the drawback of this prior art system resides in the fact that since the compressor 25 is provided in the working fluid flow circuit it tends to introduce lubrication oil into the solution or introduce the latter into the internal structure of the compressor 25. This would require the development of a compressor which is tailored to meet this purpose.

FIG. 3 is an illustration of an embodiment of the present invention in which the same numerals are used to indicate parts corresponding to those in FIG. 1. The parts having corresponding reference numerals in FIG. 3 have corresponding significance. The refrigeration system of the invention comprises generally a main closed-loop refrigerant flow circuit 50, a first auxiliary refrigerant flow circuit 55, and a second auxiliary refrigerant flow circuit 70 connected in parallel with the first auxiliary flow circuit 55 to share a common flow path which includes an electrically driven compressor 51 and a condenser 52. The main flow circuit 50 includes the generator 1, a condenser 33, an expansion valve 34, an evaporator 35 and absorber 5. The refrigerant generator 1 contains a solution of evaporable refrigerant in a less evaporable solvent and generates pressurized vapor phase refrigerant by heating the solution with the hot water supplied from the reservoir 9. The generator 1 supplies the pressurized refrigerant to the condenser 33 and, on the other hand, supplies a solution of low refrigerant concentration to the absorber 5 via a flow path 5*a* to absorb vapor phase refrigerant supplied from the main evaporator 35 producing a solution of high refrigerant concentration. This high content solution is supplied to the pump 6 and pumped to the generator 1 for recirculation. The first auxiliary flow circuit 55 further includes an evaporator 43 and a diaphragm-operated expansion valve 44. The evaporator 43 forms a section of the flow circuit which is an outer tubing of a concentrical condenser-evaporator structure of which the inner tubing is formed by the condenser 33 of the main flow circuit 50. The second auxiliary flow circuit 70 includes an expansion valve 45 and an auxiliary evaporator 46. The auxiliary evaporator 46 is accommodated in a common water tank 47 together with the main evaporator 35 and a cooling coil 48 for delivery of cooled water for utilization. One of the expansion valves 34 and 45 is adjusted so that the vapor pressure of the refrigerant in each of the associated flow circuits is substantially equal to the vapor pressure of the other flow circuit.

The diaphragm-operated expansion valve 44 comprises a diaphragm 59 defining upper and lower chambers, a spring 63 fitted between the diaphragm 59 and a valve seat 61 which defines a valve opening with a valve member 62 secured to the diaphragm 59. The upper chamber of the valve 44 is in communication with the refrigerant generator 1 through a flow circuit 60 so that the pressure in the lower chamber is at balance against the vapor pressure in the generator 1. The pressure in the lower chamber and hence the pressure in the evaporator 43 is determined such that it is lower than that in condenser 33 at all times by an amount determined by the spring 59 until the valve 44 is closed.

The operation of the refrigeration system of the invention will now be described. The compressor 51 supplies pressurized vapor phase refrigerant to the condenser 52 from whence it is discharged in liquid phase to the lower chamber of the expansion valve 44 and thence to the evaporator 43 where thermal energy is extracted from the vapor phase refrigerant passing through the other tubing 33 acting as a condenser. If the solar energy is such that the temperature of the solution in the generator 1 is higher than the temperature required for the generated refrigerant to condense in the condenser 33, the refrigerant in the auxiliary flow circuit 55 is routed in the direction of solid-line arrows. Under this condition the vapor pressure at the entry point of the compressor 51 is considerably high so that the amount of work done by it is considerably small and the system thus operates at a relatively high efficiency. With a reduction in the temperature of the generator 1 the diaphragm 59 correspondingly moves to an upward position to thereby decrease the valve opening. As a result, the pressure in the evaporator 43 reduces automatically with the decrease in temperature of the generator 1 and hence with a decrease in solar energy to keep the condenser 33 operating efficiently although the amount of work done by the compressor 51 will increase with the temperature reduction in the generator 1.

If the solution temperature in the generator 1 further reduces so that it is equal to or lower than the refrigerant evaporation temperature in the evaporator 35, the refrigerant temperature in the evaporator 43 will then become lower than the fluid temperature in the evaporator 35, so that the operation of the compressor 51 is meaningless in terms of efficiency if the refrigerant is still allowed to circulate through the valve 44. Therefore, the expansion valve 44 is closed under such conditions to direct the working fluid in the auxiliary flow circuit 55 to the expansion valve 45 and thence to the auxiliary evaporator 46 of the flow circuit 70 in the direction of broken-line arrows. The compressor 51 now serves as a main energy source to sustain refrigeration.

It is seen from the above that the arrangement of the compressor 51 in a flow circuit which is completely isolated from the main flow circuit, as taught by the present invention, eliminates the problem encountered with the second prior art of FIG. 2, while at the same time retaining its advantages over the first type of prior art system.

What is claimed is:

1. A refrigeration system comprising:

a main closed loop working-fluid flow circuit including a refrigerant generator, condenser, an evaporator and an absorber, all of which are connected in series in said flow circuit;

a first auxiliary closed loop refrigerant flow circuit including a compressor, a condenser and an evaporator, all of which are connected in series in the last-mentioned flow circuit, the evaporator of the auxiliary flow circuit being arranged to cool the condenser of said main flow circuit, said auxiliary flow circuit further including means for controlling the pressure of said auxiliary flow circuit evaporator as a function of the pressure in said refrigerant generator; and a second auxiliary refrigerant flow circuit connected in parallel with the first auxiliary flow circuit, said second auxiliary flow circuit including an evaporator located adjacent to the main flow circuit evaporator, said pressure controlling means comprising a valve for routing the refrigerant from said compressor to the evaporator of said second auxiliary flow circuit when the pressure in said refrigerant generator falls below a predetermined value.

2. A refrigeration system as claimed in claim 1, wherein said predetermined value corresponds to the temperature at which the working fluid in said main flow circuit evaporator is vaporized.

3. A refrigeration system as claimed in claim 1, wherein the evaporators of the main and second auxiliary flow circuits are accommodated in a common liquid-containing tank.

4. A refrigeration system as claimed in claim 1, wherein said valve comprises:

a diaphragm defining a first chamber in communication with said refrigerant generator and a second chamber in communication with the evaporator of the first auxiliary flow circuit;

a valve member secured to said diaphragm and movably disposed with respect to a valve seat to define a valve opening therewith, said valve member and valve seat being located in said second chamber to regulate the pressure of refrigerant in the evaporator of said first auxiliary flow circuit as a function of the pressure in said first chamber; and a spring mounted between said diaphragm and said valve seat to establish a predetermined pressure relationship between said first and second chambers.

5. A refrigeration system as claimed in claim 4, wherein said valve member is arranged to close the valve opening when the pressure in said first chamber reduces to a level corresponding to the evaporation temperature of the refrigerant in the main flow circuit evaporator to direct the refrigerant from said compressor to the evaporator of said second auxiliary flow circuit.

6. A refrigeration system as claimed in claim 4, wherein said main flow circuit and said auxiliary flow circuits contains the same type of refrigerant, further comprising an expansion valve provided in one of said maind and auxiliary flow circuits to adjust the vapor pressure of the working fluid in one of said flow circuits relative to the vapor pressure of the other flow circuit so that both of said flow circuits have substantially equal vapor pressures.

7. A refrigeration system as claimed in claim 1, further comprising a solar collector and a reservoir connected in a closed loop working-fluid flow circuit therewith to hold fluid heated by solar energy in said reservoir, and means for supplying the heated fluid to said refrigerant generator to generate pressurized vapor phase refrigerant.

8. A refrigeration system as claimed in claim 1 or 7, wherein said refrigerant generator contains a solution of evaporable refrigerant in a less evaporable solvent and includes a flow path for supplying a solution of low refrigerant concentration to said absorber to permit the absorber to absorb vapor phase refrigerant supplied from said main evaporator to produce a solution of high refrigerant concentration, said main flow circuit including a pump for supplying said high refrigerant content solution to said refrigerant generator.

* * * * *